United States Patent [10]

Hilton et al.

[11] 4,052,838

[45] Oct. 11, 1977

[54] APPARATUS FOR PACKAGING NESTED, UNIFORMLY SHAPED ARTICLES

[75] Inventors: Barney W. Hilton; William E. Bembenek, both of Dallas, Tex.

[73] Assignee: Frito-Lay, Inc., Dallas, Tex.

[21] Appl. No.: 682,905

[22] Filed: May 4, 1976

[51] Int. Cl.[2] ..... B65B 35/34; B65B 39/06; B65B 5/06

[52] U.S. Cl. ..... 53/159; 53/243; 53/255

[58] Field of Search ..... 53/61, 159, 161, 243, 53/250, 253, 255, 258, 392

[56] References Cited

U.S. PATENT DOCUMENTS

| | | | |
|---|---|---|---|
| 1,993,079 | 3/1935 | Wild | 53/159 X |
| 3,374,599 | 3/1968 | Sanders | 53/392 X |
| 3,609,939 | 10/1971 | Hooper et al. | 53/159 |
| 3,744,213 | 7/1973 | Pearson | 53/243 |
| 3,782,068 | 1/1974 | Woyden et al. | 53/253 X |
| 3,824,760 | 7/1974 | Sinichenko et al. | 53/243 X |
| 3,903,674 | 9/1975 | Brush et al. | 53/188 |
| Re. 24,095 | 11/1955 | Olson et al. | 53/253 X |

*Primary Examiner*—Robert Louis Spruill
*Attorney, Agent, or Firm*—Bernard & Brown

[57] ABSTRACT

Apparatus for inserting a charge of nested, uniformly-shaped articles into a container such as a cannister. A charge of the articles, which may be uniformly-shaped articles and may be fragile articles such as farinaceous food chips, is separated by a metering unit from a supply of such articles and transferred into a hollow sleeve member. The filled sleeve member is rotated to a container-receiving position in which a container, such as a cardboard or paperboard cannister having one open end, is positioned over the filled sleeve member. The filled sleeve and container are then rotated to a release position in which the container, with the charge of nested, uniformly-shaped articles therein, is released from the sleeve member onto a receiver such as a conveyor which moves the filled container for further processing, for example purging with an inert gas and closing the open end. The metering unit may be, by way of example, a conveyor having a pair of gates which operate to separate a charge of the desired size from the supply of nested, uniformly-shaped articles. The metering unit can include a discharge portion pivotally attached to the conveyor main portion and contacting the sleeve member to assure against any of the articles failing to enter the sleeve member, with the discharge portion pivoting from the path of travel of the sleeve member as the sleeve member is rotated from the filling position. A plurality of hollow sleeve members can extend from a rotatable hub to move between angularly spaced filling, container-receiving, and container-discharge positions.

17 Claims, 5 Drawing Figures

APPARATUS FOR PACKAGING NESTED, UNIFORMLY SHAPED ARTICLES

The present invention pertains to the packaging of articles. More particularly, the present invention pertains to an apparatus for inserting a charge of articles such as nested, uniformly-shaped articles, e.g., uniformly-shaped food chips, within a container.

Potato chips have for many years been made of slices of whole potato. In has been recognized, however, that such potato chips have certain shortcomings. Since the fried potato chips are not uniformly-shaped, they must be packaged in large containers for a given weight. To be economical, these containers must be relatively inexpensive, which generally means the chips will be subject to deterioration within a short period of time due to contact with the air which is in or leaks into the package. Corn chips have likewise generally been fried into non-uniform shapes, and their packaging and storage stability meet similar difficulties.

Within recent years there have been developed methods of making potato or corn chips from dough to overcome many of these shortcomings. Uniformly shaped chips can be cut from the dough, and the chips can be fried while physically-restrained in a predetermined position, e.g., in a mold. The mold can have a curved shape which produces uniformly-shaped, curved chips. The uniformity of shape permits packaging in relatively smaller containers which can be made more or less air tight. These chips, when packaged in air tight containers in an inert atmosphere deteriorate very slowly, and so the shelf-life of the product is quite improved.

In the making of food chips from dough, the dough may be processed in flat form, for example, by forming a thin ribbon of dough. The desired shape of uncooked chips is cut from the dough, and the chips are cooked in a deep fat fryer. One frying technique involves physically restraining the chips in a curved shape during the frying process so that the resulting cooked chips are uniformly shaped. Not only do these chips have eye appeal, but also they can be packaged within a cylindrical container in a manner minimizing breakage during shipment and handling. The container is relatively small for a given weight of chips and may be a paperboard or cardboard cannister having metallic ends and suitably treated to inhibit ready passage of air or other gas therethrough. The stacked packaging of the chips in an air tight container under an inert atmosphere can materially extend the shelf-life of the chips. To be economically most advantageous, the packaging process should be accomplished in an automated manner.

The present invention is an apparatus for inserting within a container a charge of nested, uniformly-shaped articles, e.g., a stack of fragile articles such as farinaceous food chips. In accordance with the present invention, a stack of uniformly-shaped articles, which preferably have a curved or arcuate shape, is supplied to a metering unit which sequentially separates charges or slugs of the articles for packaging within respective containers. In the device a plurality of sleeves are sequentially employed to receive the separated charges, and the separated charges of nested, uniformly-shaped articles are transferred into their respective sleeves. The filled sleeves are rotated from the charge-receiving position to a container-receiving position in which a container is positioned over the sleeve to enclose both the sleeve and the charge of uniforml-shaped articles.

Further rotation of the sleeve brings it, its container, and the charge of articles to a discharge position in which the container and its charge of articles are discharged from the sleeve, with the charge of articles remaining within the container. Upon discharge from the sleeve, the container, with the charge of articles therein, is received upon a conveyor which conveys it for further processing, for example, filling of the container with inert gas, closing, and sealing.

These and other aspects and advantages of the present invention are more apparent from the following detailed description, particularly when considered in conjunction with the accompanying drawings in which like parts bear like reference numerals. In the drawings.

Figure 1:
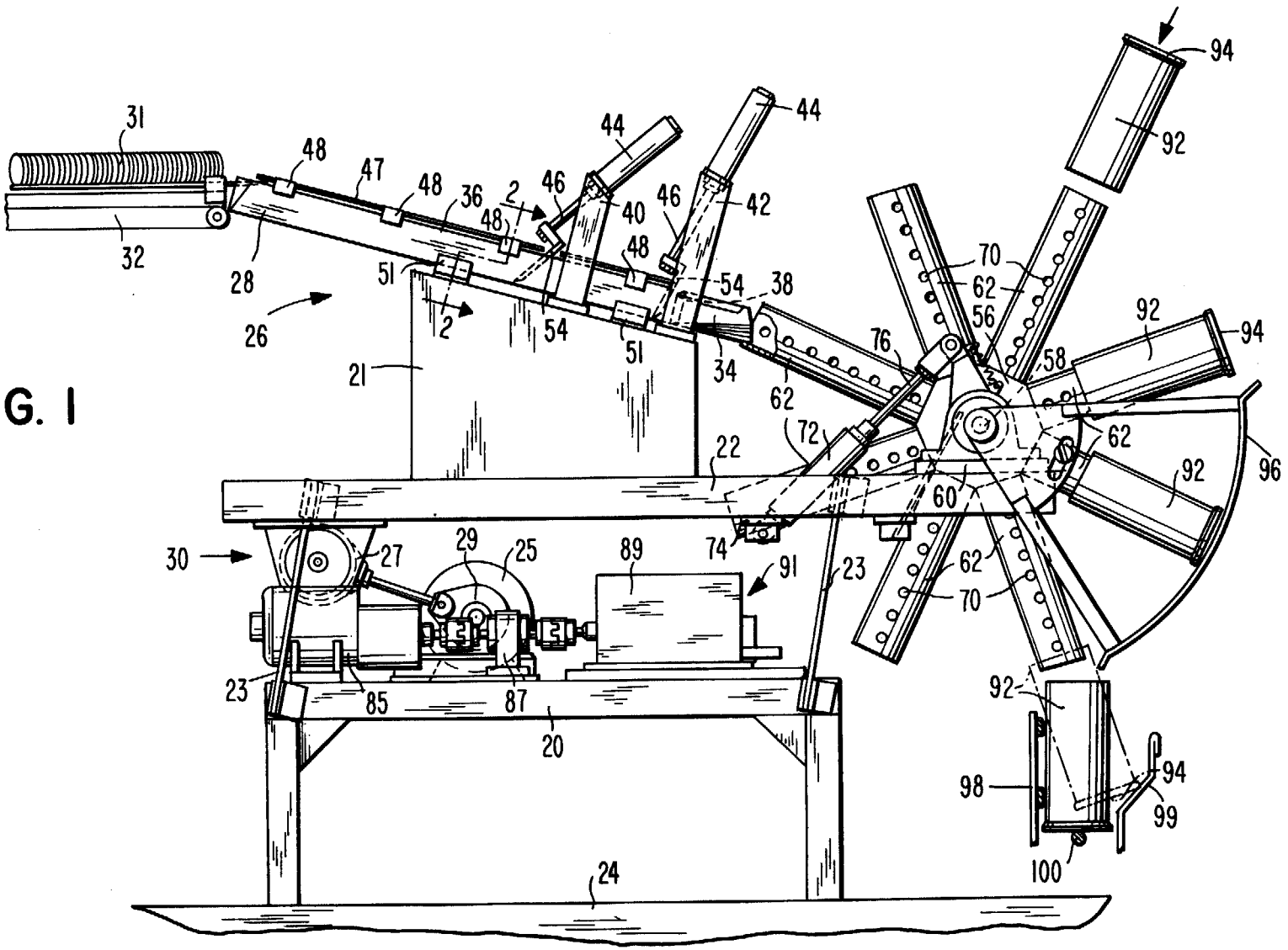
FIG. 1 is a side elevational view of apparatus for the packaging of uniformly-shaped, curved articles in accordance with the present invention.

As seen in FIG. 1, support frame 20 supports base member 22 and vibrator assembly 30 on support surface 24 which can be a floor or other suitable supporting surface. Base member 22 is supported on support frame 20 by means of four spring members 23, only two of which are seen in FIG. 1, and which permit vibration of base member 22 relative to support frame 20. The other two spring members are similarly positioned on the opposite side of base member 22. Vibrator assembly 30 includes motor 25, bearing unit 27, and eccentric coupling unit 29. Actuation of motor 25 thus causes vibration of base member 22 relative to support frame 20 and support surface 24.

Figure 2:
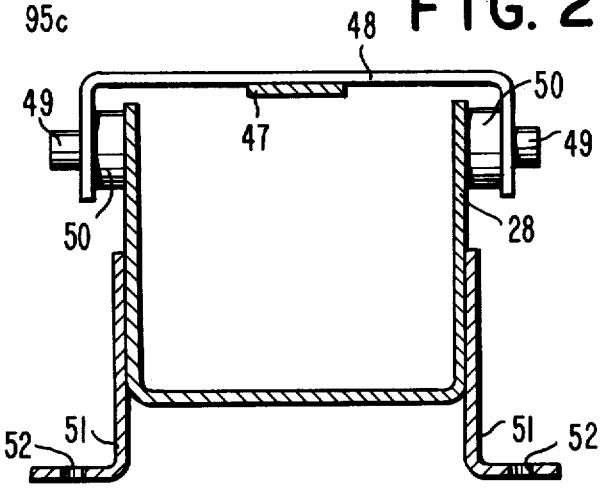
FIG. 2 is an enlarged sectional view taken along line 2—2 of FIG. 1.

Mounting member 21 mounts conveyor assembly 26 on base member 22 for vibration therewith and includes a conveyor trough 28 which is made up of a main portion 36 and a discharge portion 34. Conveyor trough 28 may typically have a length in the order of about two-and-a-half times the desired length of the charge of uniformly-shaped articles to be placed within each container, e.g., a conveyor length of about 20 to 30 inches. The height and width of conveyor trough 28 may be largely dependent upon the dimensions of the uniformly-shaped articles to be packaged. Preferably, the interior dimensions of conveyor trough 28 are slightly greater than the dimensions of the articles to be packaged to permit ready movement of the articles through the conveyor trough, and for the packaging of food chips conveyor trough 28 typically may have a width and height in the order of about two to three inches, and its lower inside surface may be flat. Preferably, as depicted in FIG. 2, a guide 47 is positioned above conveyor trough 28 to retain the articles therein. Guide 47 is supported by bracket 48 which is held in place by means such as cap screws 49 which mate with mounts 50 that are welded to the upper outside surfaces of conveyor trough 28. Mounting clips 51 are secured to the lower bottom outside surfaces of trough 28 and have openings 52 therethrough for bolts to secure trough 28 to mounting member 21.

A nested stack of uniformly-shaped articles 31 is discharged from a supply conveyor 32 into conveyor trough 28. Discharge portion 34 of conveyor trough 28 is pivotally attached to the main portion 36 thereof by pivot members 38, which by way of example may be rivets, to permit a free-swinging, upward movement of discharge portion 34 relative to main portion 36. Discharge portion 34 may have a length in the order of about five inches, and in its lower, stationary position, as depicted in FIG. 1, its rear edges contact and underlap main portion 36 to the extent of, for instance, about one-half inch. Preferably, conveyor trough 28 is oriented at a downward angle in the direction of travel of the articles thereon, for example, a moderate angle, say of the order of about 15°, to aid the conveying of the uniformly-shaped articles thereon.

A pair of metering gates 40 and 42 are provided to meter movement of articles on conveyor trough 28 to sequentially separate charges or slugs of such articles. Each metering gate 40 and 42 includes a piston member 44, such as a pneumatic piston or an air cylinder, which is mounted so that in its non-actuated condition its plunger 46 extends downwardly to extend a finger member 54 into the path of travel of articles in conveyor trough 28. When piston member 44 is actuated, the plunger 46 is withdrawn upwardly within piston member 44, and finger member 54 is withdrawn from the path of travel of articles in conveyor trough 28.

When it is desired to obtain a charge or slug of articles for packaging, metering gate 40 is activated to lift its finger 54 from within conveyor trough 28. The articles 31 then slide downwardly on conveyor trough 28 until they encounter finger 54 of metering gate 42. When a full charge of articles is provided in the trough 28 between the finger 54 of metering gate 42 and the finger 54 of metering gate 40, gate 40 is deactivated to insert its finger 54 into the path of travel of the articles 31 on conveyor trough 28. The charge or slug of articles 31 then exists between the fingers 54 of metering gates 40 and 42. Gate 42 is then activated to remove its finger 54 from the path of travel on conveyor trough 28, permitting the charge of articles to slide forward further or downwardly on trough 28 for packaging.

Hub member 56 is rotatably mounted by shaft 58 onto support member 60 which is mounted on base member 22. A plurality of sleeves 62 are equally spaced angularly around and extend from rotatable hub member 56. Hub member 56 is rotatably moved from one set position to another corresponding in number to the number of sleeves 62 on hub member 56. In each set position of hub member 56, one of the sleeves 62 extends to a position underlying and adjacent discharge portion 34 of conveyor 28 for receipt of articles 31 therefrom. Consequently, when metering gate 42 is raised, the charge or slug of uniformly-shaped articles 31 on conveyor 28 transfers to discharge portion 34 and then into the adjacent sleeve 62.

Figure 3:
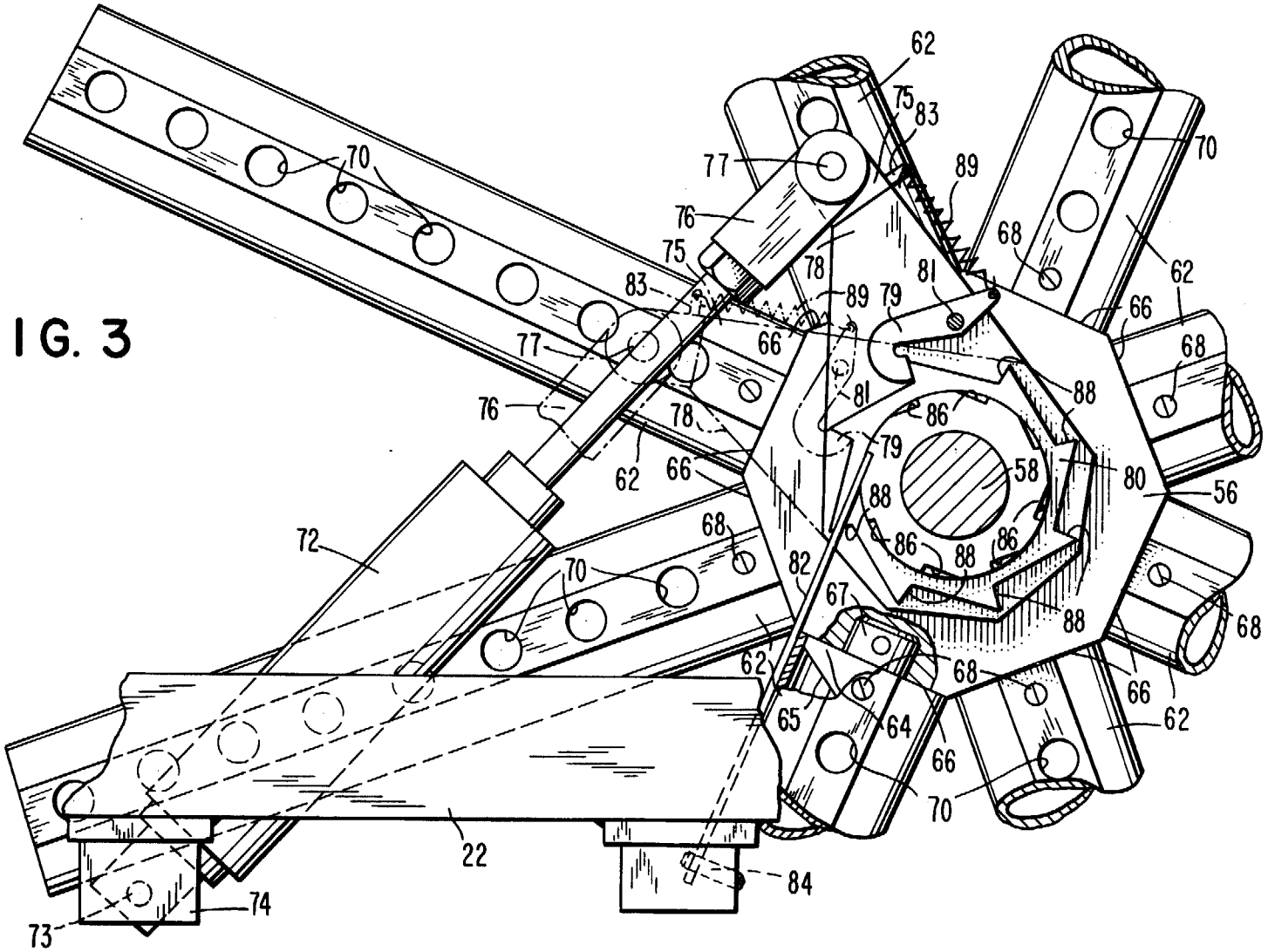
FIG. 3 is an enlarged, fragmentary, side elevational view depicting a rotatable hub member and cooperating structure suitable for incorporation into apparatus in accordance with the present invention.

FIG. 3 depicts details of a preferred embodiment of rotable hub member 56 and sleeves 62. In the illustrative form shown there, hub member 56 has the cross-section of a regular octagon and so is provided with eight faces 66. A mounting guide 64 is carried on each face 66, being secured thereon by means such as mounting member 67. The outer surface 65 of each mounting guide 64 is angled with respect to the longitudinal axis of its sleeve, for example with an angle in the order of about 53°. A sleeve 62 fits over each mounting guide 64 and is fastened thereto by means such as bolt 68. Each sleeve 62 is of a length sufficient to hold the desired charge of articles 31, for example a length in the order of about 8 to about 12 inches. Likewise each sleeve 62 is of a cross-section to loosely hold the nested stack of uniformly-shaped articles 31 so that the articles remain nested and yet freely move into or out from the sleeves 62, for example an essentially oblong cross-section slightly larger in major and minor dimensions than the articles to be packaged. To assure ready insertion and removal of the stack of uniformly-shaped articles 31 into and from sleeves 62, each sleeve 62 preferably includes a plurality of openings 70 along the length thereof so that air pressure does not hamper this movement of the stacked articles. Openings 70 also allow viewing of the articles 31 within the sleeves 62, permitting any operating malfunctions to be noticed. If desired one or more slots, not shown, can extend the length of each sleeve 62 to permit manual removal of articles 31 therefrom.

Piston member 72, which by way of example may be a pneumatic piston, is pivotally attached by pin 73 to bracket 74 which is attached to base member 22. The plunger 76 of piston member 72 is pivotally coupled by pin 77 to arm 75 of arm and pawl assembly 78. Pawl 79 of assembly 78 is pivotally attached to arm 75 by pin 81. Pawl 79 cooperates with the catches 88 of a ratchet wheel 80 which is fixedly attached to rotatable hub member 56 on shaft 58. Spring 89 has its first end attached to pawl 79 and its second end attached by pin 83 to arm 75 to retain pawl 79 in contact with a catch 88. The first end of reversing stop 82 is fastened to base member 22 by means of fastener 84. The second end of reversing stop 82 is positioned within an L-shaped recess 86 on ratchet wheel 80. On ratchet wheel 80 there are a catch 88 and an L-shaped recess 86 associated with each sleeve 62 supported on rotatable hub member 56.

FIG. 1 depicts a set position of piston member 72 with plunger 76 retracted within piston member 72. FIG. 3 depicts this same set position in solid lines and depicts in broken lines the actuated condition of piston member 72, with plunger member 76 retracted. When a charge or slug of uniformly-shaped articles 31 has slid within the sleeve 62 adjacent discharge portion 34 of conveyor trough 28, piston member 72 is actuated to retract its plunger member 76. As plunger member 76 retracts, arm 75 is rotated counterclockwise in FIG. 3, and pawl 79 rides on the surface of ratchet wheel 80 until the pawl engages the next catch 88. Piston member 72 then extends its plunger member 76, and pawl 79 acts against the catch 88 in which it is now engaged to rotate hub member 56 about the axis of shaft 58, bringing the next sleeve 62 adjacent discharge portion 34. The lower surface of discharge portion 34 enters the sleeve 62 slightly. As hub member 56 and sleeve 62 rotate, the upward movement of sleeve 62 pivots discharge portion 34 about its pivot members 38, permitting ready movement of sleeve 62. Once that sleeve 62 has cleared discharge portion 34, the discharge portion 34 returns to its rest position of FIG. 1 in which it slightly enters the next sleeve 62 when that sleeve reaches the charge-receiving set position. Plunger 76 retracts and extends sufficiently to rotate hub 56 a sufficient amount to bring such next sleeve adjacent discharge portion 34. Thus, in the illustrative embodiment of FIGS. 1 and 3, plunger 76 retracts and extends an amount sufficient to rotate hub member 56 45° in the case of an octagon-shaped hub member 56.

In the set condition, reversing stop 82 is positioned within a recess 86 to prevent ratchet wheel 80, and thus rotatable hub member 56 to which the ratchet wheel is keyed, from rotating backwards. During forward rotation of ratchet wheel 80, as plunger member 76 extends, the end of reversing stop 82 rides on the surface of the ratchet wheel to engage the next recess 86. Preferably, in the quiescent or set condition, the sleeve 62 adjacent discharge portion 34 is slightly angled downwardly from its outer end, for example with a downward inclination in the order of about twenty degrees from the horizontal. This positioning, together with the vibration imparted by vibrator assembly 30, assists the stack of uniformly-shaped articles 31 in entering sleeve 62 and assures that none of the articles 31 falls from the sleeve 62 when piston member 72 is actuated. The angling of outer surface 65 of mounting guide 64 aids the articles 31 in standing on edge to nest within sleeve 62.

After the filled sleeve 62 rotates from the charge-receiving set position adjacent discharge portion 34, it reaches, in two movements in the embodiment illustrated, a higher set position at which a cannister 92 is inserted over the sleeve 62. In the illustrative showing of FIGS. 1 and 3, eight sleeves 62 are provided, and so each actuation of piston member 72 rotates hub member 56 and sleeves 62 45°. Consequently, when a sleeve 62 is filled at the charge-receiving set position adjacent discharge portion 34, the next actuation of piston member 72 brings that filled sleeve to an intermediate set position at which no action takes place as to that sleeve, and the next actuation of piston member 72 brings that filled sleeve to the container-receiving set position at which a cannister 92 is inserted over the filled sleeve. It is not essential that the intermediate set position be used, and it may be omitted if the angular spacing between the article-receiving position and the container-receiving position of a sleeve is the same as the angular rotation achieved during a single actuation of piston member 72 and rotational movement of hub member 56.

Figure 4:
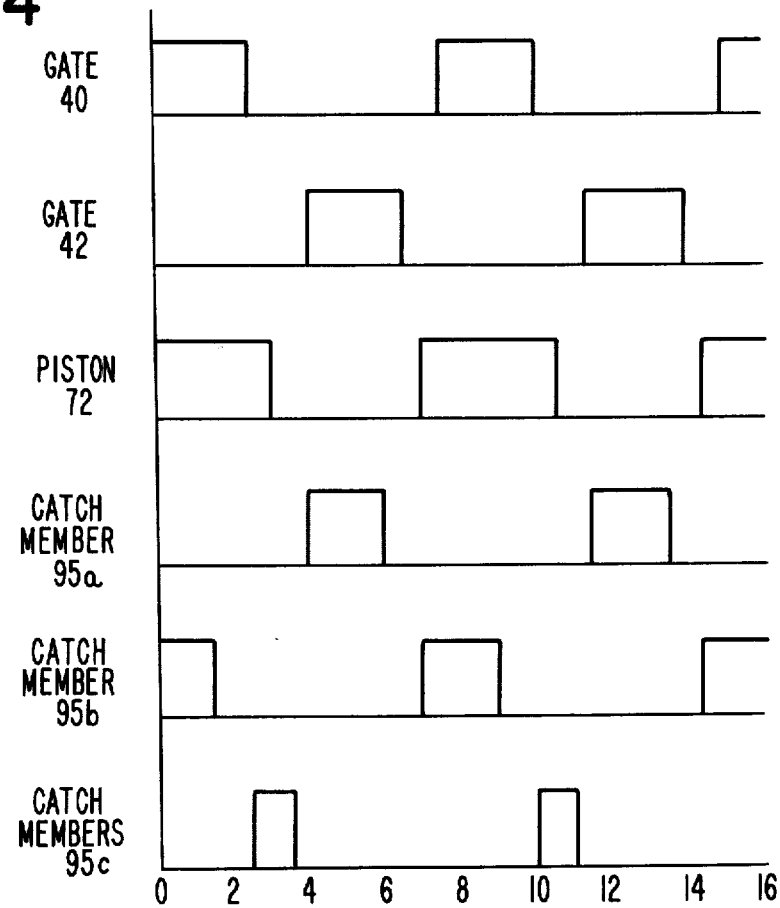
FIG. 4 is a timing diagram depicting an illustrative timing cycle for the apparatus of FIG. 1 in accordance with the present invention.

Operation of the present invention can be controlled by sequencing unit 91, depicted in FIG. 1 as mounted on support frame 20. Sequencing unit 91 can include a motor 85, reduction gearing 87 and a pneumatic sequencer 89 which controls valved outlets by means of which hoses (not shown) couple a gas source to the piston members 44 of gates 40 and 42 and to piston member 22. Pneumatic sequencer 89 can be operated at any desired speed, for example at a speed in the order of about five to about ten cycles per minute. FIG. 4 is a timing diagram illustrating typical operation at a speed of eight cylces per minute or one cycle every seven-and-one-half seconds and illustrates the cycle as commencing with the actuation of gate 40 to separate a charge of articles. In this illustrative cylce, sequencing unit 91 actuates the piston 44 of gate 40 at time zero and retains gate 40 in its actuated condition with its finger 54 withdrawn from conveyor trough 28 for 2.5 seconds. When gate 40 is deactivated, its finger 54 returns to trough 28, isolating the charge of articles between gate 40 and gate 42. At 4 seconds after time zero the piston 44 of gate 42 is actuated to withdraw the finger 54 of that gate from conveyor trough 28, allowing the charge to enter the sleeve 62 which is adjacent discharge portion 34. At 6.5 seconds after time zero, gate 42 is deactivated to return its finger 54 to conveyor trough 28, and at 7 seconds after time zero piston 72 is actuated to rotate hub member 56. Rotation of hub member 56 is completed and piston 72 deactivated at 10.5 seconds after time zero. Meanwhile, 7.5 seconds after time zero, gate 40 is again actuated to separate another charge for the next cycle of operation. Thus, at the same time that hub member 56 is rotating to remove a sleeve 62 with one charge of articles therein, the next charge is being separated on conveyor trough 28.

Figure 5:
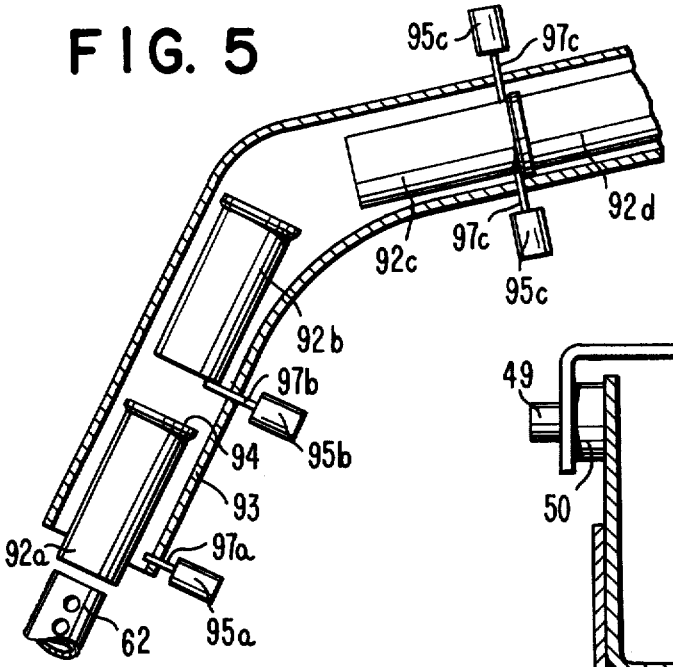
FIG. 5 is a sectional view depicting an illustrative container supply unit suitable for incorporation into apparatus in accordance with the present invention.

The cannisters 92 may be inserted over the filled sleeves 62 manually by an operator who oversees proper performance of the apparatus of the present invention. Preferably, however, the cannisters 92 are inserted automatically during the periods when rotatable hub 56 is at rest in its set positions. By way of example, FIG. 5 depicts an illustrative cannister supply 93 having an outlet opening adjacent the cannister-receiving set position of the sleeves 62. A solenoid-operated catch member **95*a* is positioned to extend its plunger 97*a* adjacent the outlet of supply 93 to intersect the path of travel of cannisters 92 therein so that when catch member 95*a* is in its non-actuated condition, plunger 97*a* prevents passage of cannisters from supply 93. Similarly, solenoid-operated catch member 95*b* is positioned to extend its plunger 97*b* into the path of travel of cannisters at a point upstream from catch member 95*a* sufficient to permit one cannister 92*b* to be held between catch member 95*a* and catch member 95*b*. Solenoid-operated catch members 95*c* are positioned to hold one cannister 92*c* above cannister 92*b*. Additional cannisters 92*d*, etc. are behind cannister 92*c*, being retained by cannister 92*c*. Preferably, catch members 95*a* and 95*b* extend into the path of cannister travel within supply 93 a sufficient distance to block the leading end of the cannisters therein, while catch members 95*c* extend from opposite sides of supply 93 only a distance sufficient to catch rim 94 on the trailing end of the cannisters. With cannister 92*a* held by catch member 95*a*, cannister 92*b* held by catch member 95*b*, cannister 92*c* held by catch members 95*c*, and cannisters 92*d*, etc. behind cannister 92*c*, a sleeve 62 filled with a nested stack of uniformly-shaped articles such as curved food chips 31 rotates to the container-receiving position of hub member 56. Solenoid-operated catch member 95*a* is then actuated to withdraw its plunger 97*a* from the path of travel of the cannisters within supply 93, as depicted in FIG. 5. Cannister 92*a* then moves onto the filled sleeve 62. Catch member 95*a* is then deactivated to again extend its plunger 97*a*, following which catch member 95*b* is actuated to withdraw its plunger 97*b*, allowing cannister 92*b* to move forward until it is restrained by catch member 95*a*. Catch member 95*b* is then deactivated, after which catch members 95*c* are actuated to release cannister 92*c* to catch member 95*b*. As cannister 92*c* advances, the cannisters 92*d*, etc. behind it also advance, and after rim 94 of cannister 92*c* and the leading end of cannister 92*d* have cleared catch members 95*c*, those catch members are deactivated to extend their plungers 97*c* so that plungers 97*c* ride against the outer surface of cannister 92*d* as cannister 92*d* advances, and so plungers 97*c* catch cannister 92*d* by its rim 94. The advancement of cannisters 92*b*, 92*c*, 92*d*, etc. takes place as hub member 56 is rotating to bring another filled sleeve 62 to the container-receiving position. Thus, when that filled sleeve 62 is at the container-receiving position, a cannister 92 is available at the outlet of supply 93**.

Timing of the operation of this illustrative cannister supply 93 is shown in FIG. 4. At 4 seconds after time zero, while rotatable hub 56 is stationary or set, solenoid-operated catch member **95*a* is actuated to withdraw its plunger 97a from the path of cannisters 92 within cannister supply 93. Cannister 92a then moves onto the filled sleeve 62 which is at the container-receiving set position of hub member 56. After sufficient time for cannister 92a to have cleared plunger 97a, e.g., at 6 seconds after time zero, catch member 95a is deactivated to again extend its plunger 97a. Once plunger 97a is extended, e.g., at 7 seconds after time zero, solenoid-operated catch member 95b is actuated to withdraw its plunger 97b, allowing cannister 92b to proceed to plunger 97a. After a time sufficient for cannister 92b to have cleared plunger 97b, e.g., at 9 seconds after time zero, catch member 95b is deactivated to return its plunger 97b across the path of travel within supply 93. After plunger 97b is extended, e.g., at 10 seconds after time zero, solenoid-operated catch members 95c are actuated to withdraw their plungers 97c, allowing cannisters 92c, 92d, etc. to advance, and after rim 94 of cannister 92c and the leading edge of cannister 92d have passed plungers 97c, e.g. 11 seconds after time zero, catch members 95c are again deactivated to extend their plungers 97c to catch cannister 92d by its rim 94. In the meantime gates 40 and 42 and piston 72 have been operating to remove the cannister-covered sleeve 62 from the container-receiving set position and to bring another filled sleeve to that set position adjacent cannister supply 93, and so solenoid-operated catch member 95a** is again actuated 11.5 seconds after time zero to repeat the cannister supply cycle.

The cannisters 92 are preferably each a cylindrical sleeve of, for example, a cardboard or paperboard and having the outer or upper end 94 closed, for example by a metal closure member, when the cannister is in position for insertion over sleeve 62. With each subsequent actuation of piston member 72, the filled sleeve 62 with cannister 92 positioned thereon rotates to a new, more downwardly position. As seen in FIG. 1, a shield member 96 is provided to assure that the cannister 92 does not prematurely fall from sleeve 62 after it passes the horizontal position. Shield member 96 terminates at a point such that when piston member 72 has rotated hub member 56 to bring the cannister-covered sleeve 62 beyond shield member 96, cannister 92, with the charge of uniformly-shaped articles 31 therein, discharges from sleeve 62 and is guided by guide members 98 and 99 on opposite sides of the cannister 92 to rest on its closed end 94 on conveyor 100 which conveys the filled cannister 92 for further processing, such as purging the air therefrom with inert gas, closing and sealing.

To review the operation with reference to FIG. 1, stacked, uniformly-shaped articles, such as uniformly-shaped, curved food chips, are supplied in nested relationship on conveyor 32 to conveyor trough 28. Metering gate 40 has its finger 54 in lowered position to restrain the stack from further advancement until it is desired that a charge of articles be separated for packaging. At that time, metering gate 42 has its finger 54 down in the position depicted in FIG. 1, and the finger 54 of metering gate 40 is lifted, permitting the stack of articles to advance. Gate 42 restrains the articles from further advancement, and when a charge has been assembled between metering gates 40 and 42, the finger 54 of gate 40 is again lowered. The finger 54 of gate 42 is then raised, permitting the charge of articles to slide across discharge portion 34 and into the sleeve 62 which is adjacent discharge portion 34. When the charge of articles has passed gate 42, finger 54 of gate 42 is again lowered, and when the charge of articles is in the sleeve 62, piston member 72 is actuated to rotate hub member 56, moving the filled sleeve 62 upwardly and bringing an empty sleeve 62 into position adjacent discharge portion 34. Discharge portion 34 is swung upwardly by sleeve 62 as hub member 56 rotates. A cannister or other suitable container 92 is inserted over the filled sleeve 62 which is positioned at the container-receiving position of hub 56. As hub member 56 rotates further in subsequent cycles, the filled sleeve 62 rotates, with the cannister 92 and it stack of articles being retained on sleeve 62 by guard member 96 until reaching the discharge position, at which point the cannister 92, with the stack of uniformly-shaped articles therein, moves under the urging of gravity from sleeve 62 to discharge onto conveyor 100 which conveys the container of stacked packaged articles for further processing.

It will be recognized that several of the described actions may be going on simultaneously with respect to different charges of the uniformly-shaped articles 31. Thus when hub 56 is stationary, one charge may be forming between gates 40 and 42 while another may be filling a sleeve 62. Simultaneously, a previously filled sleeve 62 may be receiving a cannister 92, and a previously inserted cannister 92 may be discharging from its sleeve 62 to conveyor 100. The timing of the raising and lowering of arms 40 and 42 can be such that a charge of articles is assembled therebetween immediately after finger 54 of gate 42 is lowered and while the hub member 56 is is motion, thereby speeding up the operation.

The present invention has been described with reference to a single feed conveyor 32 supplying a single metering unit to fill sleeves 62 of a single rotatable hub 56. Multiple units can be provided to operate in parallel, one behind the next as viewed in FIG. 1, with the units discharging filled containers 92 simultaneously or alternately onto a single conveyor 100 or onto multiple conveyors which remove filled cannisters from the discharge positions of separate rotatable hub systems. A single conveyor can be operated at a speed such that the filled containers are deposited from the several units in appropriatly spaced relationship to fit on the single conveyor, or it can be operated at a speed sufficiently great to remove each cannister from the area of the several units before another cannister is deposited on the conveyor. Likewise, while FIG. 1 illustrates a preferred embodiment of the present invention in which base members 22 is vibrated to vibrate conveyor trough 28 and rotatable hub member 56, other conveying methods could be used, including maintaining base member 22 stationary while vibrating conveyor trough 28 or other selected components of the apparatus. Although the present invention has been described with reference to preferred embodiments, numerous rearrangements and alternations could be made, and still the apparatus would come within the scope of the invention.

What is claimed is:

1. Apparatus for inserting individual charges of nested, uniformly-shaped articles into containers comprising:

transfer and metering means for sequentially metering and separating individual charges of nested, uniformly-shaped articles from a supply thereof, including downwardly inclined conveyor means along which said individual charges move, said conveyor means having a lower discharge portion;

packaging means comprising a rotatably mounted hub member; and a plurality of sleeve members on said hub member, said sleeve members extending radially outwardly from said hub member and the outer end of said sleeve members being open and adapted to receive a said individual charge, said hub member being rotatably mounted adjacent said transfer and metering means for cooperation therewith to bring said outer end of respective ones of said sleeves adjacent said discharge of the conveyor means as said hub member rotates into the charge-receiving position in which said cooperating sleeve inclines downwardly from its outer end, said cooperating packaging means and said transfer and metering means being adapted for an individual charge to be transferred from said conveyor means discharge into the cooperating one of said sleeves, said sleeve members during rotation of said hub member moving intermittingly to said charge-receiving position and in sequence thereafter to an upper container-receiving position and in which the sleeve in container-receiving position is in the upper portion of the path of rotation of said sleeves, and is adapted for a container to be passed over said sleeve member, and to a discharge position in which the container with the charge contained therein is discharged from said sleeve member when the latter is positioned in the lower portion of said path of rotation;

rotating means for rotating said hub member to sequentially move each said sleeve member in a step-wise fashion to said charge-receiving position, upwardly to said container receiving position, and downwardly to said container discharge position, said transfer and metering means including means for metering a said individual charge into said cooperating sleeve in charge-receiving position; and receiving means adjacent said discharge position of the sleeves for receiving containers with a charge of nested, uniformly-shaped articles therein.

2. Apparatus as claimed in claim 1 in which said transfer and metering means includes first and second, spaced-apart gating means, said first gating means sequentially separating on said conveyor means individual charges of nested, uniformly-shaped articles, each said gating means having a first position permitting the passage of said articles on said conveyor means and a second position in which said articles are prevented from passing, means for moving said first gating means to its said first position to permit articles to pass on said conveyor means to said second gating means in its said second position to form an individual charge and for then moving said first gating means to its said second position to separate said last-mentioned individual charge from a supply of said articles, and means for then moving said second gating means to its said first position to permit an individual charge at said second gating means to pass into said cooperating sleeve.

3. Apparatus as claimed in claim 2 in which each of said first and second gating means comprises gating piston means including a gating plunger movable between a retracted position corresponding to said first position and an extended position corresponding to said second position, said gating plunger in said extended position including means inserted into the path of travel of nested, uniformly-shaped articles on said conveyor means.

4. Apparatus as claimed in claim 3 in which said conveyor means is a vibrating slide conveyor.

5. Apparatus as claimed in claim 1 in which said rotating means comprises pivotal piston means having a plunger movable between a retracted position and an extended position, a ratchet wheel mounted for rotation with said rotatable hub member, and a pawl assembly movable by said plunger and engaging said ratchet wheel to rotate said ratchet wheel and said rotatable hub member upon movement of said plunger between the retracted position and the extended position.

6. Apparatus as claimed in claim 1 having means for holding said containers on their respective sleeves during travel from said container-receiving position to said discharge position.

7. Apparatus as claimed in claim 1 further comprising means for placing a container around a charge-filled sleeve member in said container-receiving position.

8. Apparatus for inserting individual charges of nested, uniformly-shaped articles into containers comprising:

transfer and metering means for sequentially metering and separating individual charges of nested, uniformly-shaped articles from a supply thereof, including downwardly inclined conveyor means along which said individual charges move by gravity, said conveyor means having a lower discharge;

packaging means comprising a hub member mounted for rotation about a horizontal axis; and a plurality of sleeve members having one end secured to and closed by said hub member, said sleeve members extending outwardly from said hub member and having an open outer end adapted to receive one of said individual charges, said hub member being rotatably mounted adjacent said transfer and metering means for cooperation therewith to bring said open end of a cooperating sleeve adjacent said discharge of the conveyor means as said hub member rotates into a charge-receiving position, said cooperating sleeve in charge-receiving position sloping downwardly toward the closed end thereof, said transfer and metering means being adapted for gravity transfer of individual charges across the discharge of said conveyor means into said cooperating sleeve, said sleeve members during rotation of said hub member passing through said charge-receiving position and in sequence thereafter an upper, container-receiving position in which it is adapted for a container to be passed over said sleeve member, and a lower discharge position in which the container with the charge contained therein is discharged by gravity from said sleeve member;

rotating means for rotating said hub member to sequentially move said sleeve members in a step-wise fashion to said charge-receiving position, said upper container-receiving position and said lower discharge position means, said transfer and metering means including means operatively connected with said rotating means for metering one of said individual charges into said cooperating sleeve; and receiving means adjacent said discharge position of the sleeves for receiving containers with a charge of nested, uniformly-shaped articles therein.

9. Apparatus as claimed in claim 8 in which said transfer and metering means includes first and second, spaced-apart holding means, said first and second holding means sequentially separating the nested, uniformly-shaped articles on said conveyor means into individual charges and controlling the transfer of an individual charge across said discharge into said cooperating sleeve.

10. Apparatus as claimed in claim 9 in which each of said holding means includes a member adapted for insertion into and removal from the path of travel of said nested, uniformly-shaped articles on said conveyor means.

11. Apparatus as claimed in claim 9 in which said rotating means comprises piston means having a plunger movable between a retracted position and an extended position, a ratchet wheel mounted for rotation with said rotatable hub member, and a pawl assembly connected to said plunger and engaging said ratchet wheel to rotate said ratchet wheel and said rotatable hub member upon movement of said plunger between the retracted position and the extended position.

12. Apparatus as claimed in claim 8 further including means for placing a container on said outer end of the sleeve in said container-receiving position, said container moving by gravity to surround said sleeve, and means for holding said containers around their respective sleeves during travel of said sleeves from said container-receiving position to said discharge position.

13. Apparatus as claimed in claim 12 in which said transfer and metering means includes first and second, spaced-apart gating means, said first gating means sequentially separating individual charges of nested, uniformly-shaped articles on said conveyor means, each said gating means having an actuated position permitting the passage of said articles on said conveyor means, and a non-actuated position in which said articles are prevented from passing, means for moving said first gating means to its actuated position to permit articles to pass to said second gating means in its non-actuated position to form an individual charge and for then deactivating said first gating means to separate said last-mentioned individual charge from a supply of said articles, and means for actuating said second gating means to permit an individual charge at said second gating means to pass into said cooperating sleeve.

14. Apparatus as claimed in claim 13 in which said rotating means comprises pivotal piston means having a plunger movable between a retracted position and an extended position, a ratchet wheel mounted for movement with said rotatable hub member, and a pawl assembly associated with said plunger and engaging said ratchet wheel to rotate said ratchet wheel and said rotatable hub member upon movement of said plunger between the retracted position and the extended position thereof.

15. Apparatus as claimed in claim 14 in which said conveyor means is a vibrating slide conveyor.

16. Apparatus for inserting charges of nested, uniformly-shaped articles into containers comprising:

a rotatable hub member;

a plurality of sleeve members mounted on said hub member for rotation therewith;

transfer means for transferring individual charges of nested, uniformly-shaped articles from a supply thereof into respective ones of said sleeve members;

means for rotating said hub member to move said sleeve members in turn from a charge-receiving position in which the sleeve member receives a charge of nested, uniformly-shaped articles from said transfer means, to a container-receiving position in which a container is placed around the charge-filled sleeve member, to a discharge position in which the container with a charge contained therein is discharged from said sleeve member;

said tranfer means comprising conveyor means including a main conveyor portion, a discharge portion, and attachment means for pivotally-attaching said discharge portion to said main conveyor portion, with said discharge portion contacting one of said sleeve members when said one of said sleeve members is in the charge-receiving position, metering means for metering a charge of nested, uniformly-shaped articles from a supply thereof across said discharge portion and into said one of said sleeve members; and in which upon movement of said one of said sleeve members by rotation of said hub member, said discharge portion is pivoted to permit passage of said one of said sleeve members; and receiving means adjacent said discharge position for receiving containers with a charge of nested, uniformly-shaped articles therein.

17. Apparatus for inserting a plurality of charges of nested, uniformly-shaped articles into a plurality of containers comprising:

a rotatable hub member;

a plurality of hollow sleeve members mounted on said hub member for rotation therewith;

forming means for sequentially forming a plurality of charges of nested, uniformly-shaped articles;

transfer means for sequentially transferring individual charges of nested, uniformly-shaped articles into respective ones of said sleeve members;

means for rotating said hub member to move said sleeve members sequentially from a charge-receiving position in which the sleeve member receives a charge of nested, uniformly-shaped articles from said transfer means, to a container-receiving position in which a container is placed around the charge-filled sleeve member, to a discharge position in which the container, with the charge contained therein, is discharged from said sleeve member;

said transfer means comprising conveyor means including a main conveyor portion, a discharge portion, and attachment means for pivotally-attaching said discharge portion to said main conveyor portion with said discharge portion overlapping the article receiving end of one of said hollow sleeves when in charge-receiving position;

metering means for metering a charge of nested, uniformly-shaped articles across said discharge portion and into said one of said hollow sleeve members; and in which upon movement of said one of said hollow sleeve members by said moving means, said discharge portion is pivoted from the path of travel of said one of said hollow sleeve members;

means for placing a container around respective ones of said plurality of sleeve members when the latter are in said container-receiving position; and receiving means adjacent said discharge position for receiving said containers with a charge of nested, uniformly-shaped articles therein.

* * * * *